US005156015A

United States Patent [19]

Chung

[11] Patent Number: 5,156,015

[45] Date of Patent: Oct. 20, 1992

[54] METHOD AND APPARATUS FOR CIRCULATING COLD AIR FOR AN INDIRECT-COOLING TYPE REFRIGERATOR

[75] Inventor: Chua J. Chung, Seoul, Rep. of Korea

[73] Assignee: Samsung Electronics Co., Ltd., Suwon, Rep. of Korea

[21] Appl. No.: 631,239

[22] Filed: Dec. 20, 1990

[51] Int. Cl.[5] ..... F25D 17/04

[52] U.S. Cl. ..... 62/187; 62/408; 62/443

[58] Field of Search ..... 62/187, 408, 417, 443

[56] References Cited

U.S. PATENT DOCUMENTS 2,240,882 5/1941 Brain ..... 62/187

3,590,594 7/1971 Arend ..... 62/187

*Primary Examiner*—William E. Wayner

*Attorney, Agent, or Firm*—Robert E. Bushnell

[57] ABSTRACT

A cold air circulating method and apparatus for an indirect-cooling type refrigerator which supplies the whole cold air from an evaporator only to a freezer compartment, discharges most of the cold air circulated within the freezer compartment into a fresh food compartment, while the rest of the cold air in a small amount is sucked into the evaporator, and returns the cold air circulated within the fresh food compartment into the evaporator. The apparatus includes an air duct for supplying the whole cold air from the evaporator only to the freezer compartment and a guide opening for discharging most of the cold air circulated within the freezer compartment into the fresh food compartment. This method and apparatus enable the effective use of the cold air and enhance freezing efficiency of the refrigerator.

14 Claims, 2 Drawing Sheets

METHOD AND APPARATUS FOR CIRCULATING COLD AIR FOR AN INDIRECT-COOLING TYPE REFRIGERATOR

BACKGROUND OF THE INVENTION

1. Field of the Invention

The present invention relates to a cold air circulation system of a refrigerator, and more particularly to a method of circulating the cold air for an indirect-cooling type refrigerator and the apparatus therefor.

2. Description of the Prior Art

In a conventional indirect-cooling type refrigerator, the cold air which is generated from an evaporator is separately fed to a fresh food compartment and a freezer compartment.

U.S. Pat. No. 4,704,874 in the name of James B. Thompson and Brent A. Junge, entitled "Household refrigerator air flow system" teaches a cold air circulation system for reducing a movement of a conducting heat between the evaporator region and the fresh food compartment. In the above-referenced patent, the evaporator is directly arranged at the rear side of the refrigerator, and a duct is controlled according to the operation of a compressor.

However, such a refrigeration system has disadvantages: The cooling efficiency is poor and the effective use of the cold air can not be achieved.

In addition, the above refrigeration system has a limitation in quick freezing operation.

SUMMARY OF THE INVENTION

It is an object of the present invention to provide a cold air circulating system for an indirect-cooling type refrigerator, in which the whole cold air supplied from the evaporator can be fed only to the freezer compartment so that the cooling efficiency in the refrigerator can be enhanced.

It is another object of the present invention to provide a cold air circulation system in which the freezing and refrigerating time can be shortened by adopting one-way type cold air circulation system, which allows the cold air to be fed to the evaporator through the freezer compartment and the fresh food compartment without the necessity of partial distribution of the cold air to the freezer compartment and the fresh food compartment.

BRIEF DESCRIPTION OF THE DRAWINGS

The objects and features of the present invention will become more readily apparent from the following detailed description of the preferred embodiment taken in conjunction with the accompanying drawings in which.

DETAILED DESCRIPTION OF THE PREFERRED EMBODIMENT

Prior to describing the preferred embodiment of the present invention, the above-mentioned conventional refrigerating system will be described for a better understanding of the present invention.

Figure 2:
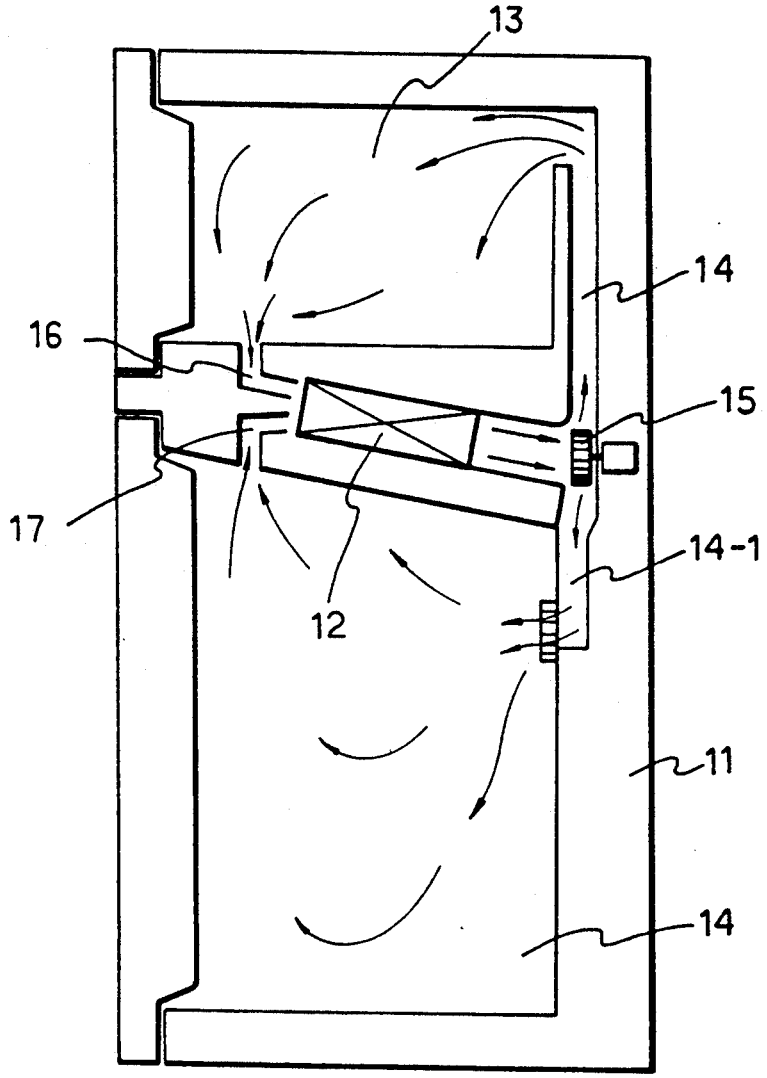
FIG. 2 PRIOR ART
FIG. 2 is a cross sectional view of a refrigerator with a conventional cold air circulation system.

One example of conventional indirect-cooling type refrigeration system is illustrated at FIG. 2.

Referring to FIG. 2, the cold air which is generated from an evaporator 12 of an indirect-cooling type refrigerator 11 is forcibly blown out by a fan 15A of a fan motor 15 and supplied separately to a freezer compartment 13 and a fresh food compartment 14 through respective flowpaths 14 and 14-1.

The cold air which flowed in the freezer compartment and the fresh food compartment allow the food stored in the freezer compartment to be frozen, while keeping the food of the fresh food compartment at a desired temperature.

The cold air circulated within the freezer and fresh food compartments 13 and 14 are sucked into the evaporator 12 through a first suction port 16 and a second suction port 17, respectively.

Therefore, in the above-mentioned conventional system, since the cold air is dispersed to the freezer compartment 13 and the fresh food compartment 14, the cooling efficiency is affected and the effective use of the cold air can not be achieved due to the difference between the desirable temperatures in the freezer compartment 13 and the fresh food compartment 14.

Figure 1:
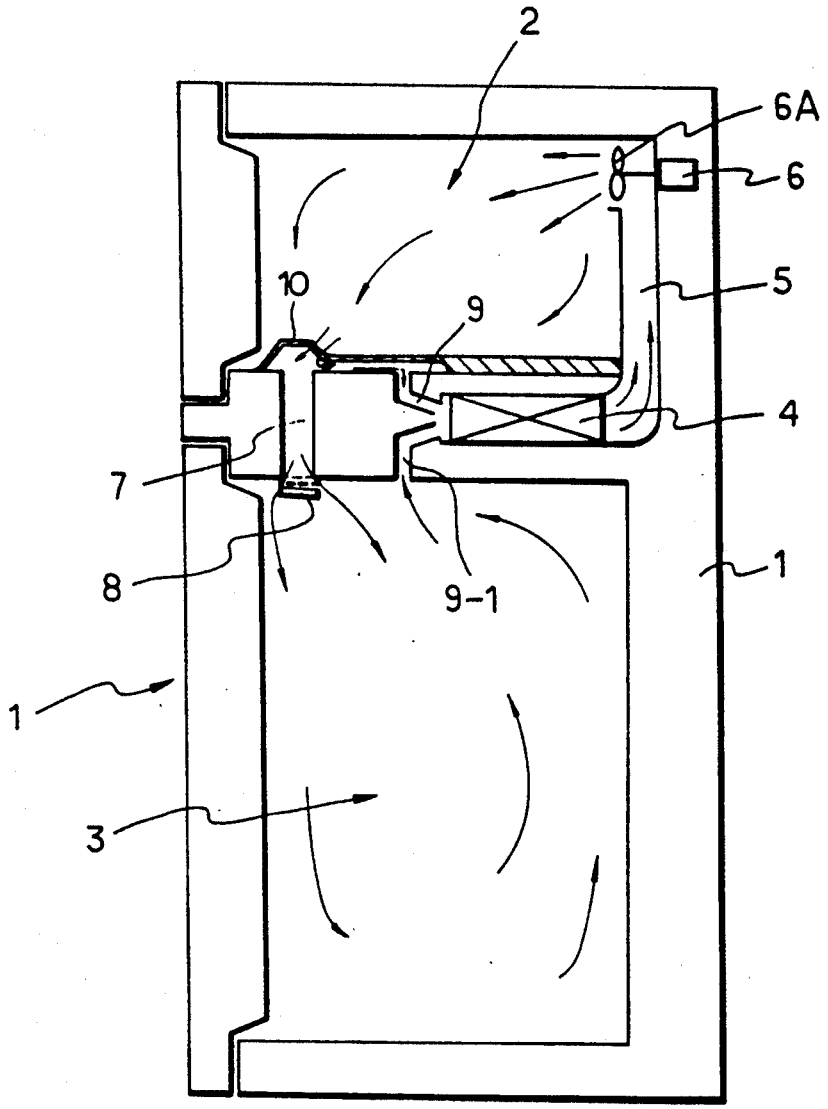
FIG. 1 is a cross sectional view of a refrigerator with a cold air circulation system according to the present invention.

FIG. 1 illustrates a cold air circulation system according to the present invention.

As shown in FIG. 1, an evaporator 4 is provided between a freezer compartment 2 and a fresh food compartment 4.

The whole cold air generated from the evaporator 4 is fed only to the freezer compartment 2 through a cold air duct 5 which communicates with the freezer compartment 2 only by a fan 6A driven by means of a fan motor 6, so that the freezing time of the food stored in the freezer compartment can be shortened.

The resultant cold air, which is flowed in the freezer compartment 2, allows the stored food to be frozen. At this time, only a small amount of the cold air is directly going back to the evaporator 4, while most of the cold air passed throughout the freezer compartment 2 is fed to the fresh food compartment 3 through a guide opening 7 which is provided with a flowpath switching device 8 for controlling the passage of the cold air.

The switching device 8 is disposed at the guide opening 7 interlocking the freezer compartment 2 and the fresh food compartment 3 so that, when the refrigerator is not able to perform properly due to a failure of the power supply, etc., or when the temperature of the fresh food compartment 3 is unduly maintained for refrigerating the food, the cold air in the freezer compartment 2 may be sucked directly to the evaporator 4 without being introduced into the fresh food compartment 3 by closing the flowpath switching device 8.

The cold air which flowed in the fresh food compartment 3 through the guide opening 7 from the freezer compartment 2 is sucked into the evaporator 4 through the second suction port 9-1 by the fan 6A with the food stored in the fresh food compartment refrigerated at a desired temperature.

As mentioned above, according to the cold air circulation system of the present invention, since the cold air cooled by the evaporator 4 is forcibly blown out only to the freezer compartment 2 through the cold air duct 5 and further flows through the freezer compartment 2, the freezing efficiency in the freezing compartment is enhanced, compared with the conventional cold air dispersing type regrigerator, so that the cooling time can be shortened.

Only a small amount of the cold air, which has carried out freezing work of the food stored in the freezing compartment 2, flows directly in the first suction port 9 and most of the cold air flows in the fresh food compartment through the guide opening 7.

Next, the cold air which flowed in the fresh food compartment 3 makes the food stored in the fresh food compartment 3 lowered to a desired refrigerating temperature, and then fed to the evaporator 4 through the second suction port 9-1.

In the meantime, when the temperature within the fresh food compartment 3 is lowered to a point less than the preset food storing temperature, the guide opening 7 is closed by means of the switching device 8, so that the temperature in the fresh food compartment 3 is maintained as it is.

Under the circumstances, if the temperature of the fresh food compartment 3 is increased, the guide opening 7 is opened by the switching device 8, so that the cold air flows into the fresh food compartment 3.

The first suction port 9 formed in the freezer compartment 2 makes the cold air in the freezer compartment 2 flow directly into the evaporator 4 only, when the guide opening 7 is closed by the switching means 8.

According to the cold air circulation system of the present invention as set forth above in detail, since the cold air cooled by the evaporator 4 is fed only to the freezer compartment, and the cold air within the freezer compartment is forced to move to the fresh food compartment as the results of one-way circulation of the cold air, the effective use of the cold air becomes possible, and consequently the freezing and refrigerating efficiency is enhanced.

In addition, since both of a portion of the cold air having passed through the first suction port and the rest of the cold air having passed through the freezer compartment and the fresh food compartment in turn are mixed and fed to the evaporator, the freezing performance of the refrigerator is not affected.

While the present invention has been described and illustrated herein with reference to a preferred embodiment thereof, it will be understood by those skilled in the art that various changes and rivisions in form and details may be made therein without departing from the spirit and scope of the invention.

What is claimed is:

1. A cold air circulating apparatus disposable within a refrigerator having a freezer compartment, a fresh food compartment, a partition separating said freezer compartment and said fresh food compartment, an evaporator disposed in said partition, a first suction port and a second suction port for sucking air circulated within said respective freezer and fresh food compartments into said evaporator, and a fan for circulating the air, said apparatus comprising:

duct means for supplying air from said evaporator to said freezer compartment, exclusively;

a guide opening for discharging a majority of the air circulated within said freezer compartment into said fresh food compartment; and switching means for automatically opening and shutting said guide opening according to the temperature within said fresh food compartment;

wherein air circulated within said fresh food compartment flows into said evaporator through said second suction port, and air circulated within said freezer compartment flows into said evaporator through said first suction port.

2. A cold air circulating apparatus as claimed in claim 1, further comprised of said switching means being disposed at an outlet of said guide means, wherein said outlet communicates with said fresh food compartment.

3. A cold air circulating apparatus as claimed in claim 1, further comprised of said guide opening being disposed within said partition, said partition being disposed in a location by said freezer compartment positioned spaced apart from said fan, so that the circulation time of the cold air within said freezer compartment may be increased.

4. A cold air circulating apparatus as claimed in claim 1, further comprised of said guide opening being disposed within in said partition and diagonally spaced away from said fan.

5. A cold air circulating apparatus as claimed in claim 1, further comprised of said guide means being disposed between said freezer compartment and said fresh food compartment, and being separated by a width of one of said freezer compartment and said fresh food compartment from said fan.

6. A cold air circulating apparatus disposable within a refrigerator having a freezer compartment, a fresh food compartment, a partition separating said freezer compartment and said fresh food compartment, an evaporator disposed within said partition, a first suction port and a second suction port for enabling entry of air circulated within said freezer compartment and said fresh food compartment, respectively, into said evaporator, and a fan for circulating the air, said apparatus comprising:

duct means for supplying air from said evaporator to said freezer compartment, exclusively;

a guide opening for discharging air from said freezer compartment into said fresh food compartment; and switching means for automatically opening and shutting said guide opening according to the temperature within said fresh food compartment;

wherein air circulated within said fresh food compartment flows into said evaporator through said second suction port, and air circulated within said freezer compartment flows into said evaporator through said first suction port.

7. A cold air circulating apparatus as claimed in claim 6, further comprised of said switching means being disposed at an outlet of said guide opening, wherein said outlet communicates with said fresh food compartment.

8. A cold air circulating apparatus as claimed in claim 6, further comprised of said guide opening being disposed between said freezer compartment and said fresh food compartment, and being separated by a width of said freezer compartment from said fan.

9. A cold air circulating apparatus, as claimed in claim 6, wherein said guide opening is a passage formed through said partition.

10. A cold air circulating apparatus disposable within a refrigerator having a freezer compartment, a freezer compartment door for allowing access to said freezer compartment, a fresh food compartment, a fresh food compartment door for allowing access to said fresh food compartment, a partition separating said freezer compartment and said fresh food compartment, an evaporator, a first suction port and a second suction port for enabling entry of air circulated within said freezer compartment and said fresh food compartment, respectively, into said evaporator, and a fan for circulating the air, said apparatus comprising:

duct means for supplying air from said evaporator to said freezer compartment, exclusively;

a guide opening for discharging air from said freezer compartment into said fresh food compartment; and switching means for automatically opening and shutting said guide opening according to the temperature within said fresh food compartment;

wherein air circulated within said fresh food compartment flows into said evaporator through said second suction port, and air circulated within said freezer compartment flows into said evaporator through said first suction port and said freezer compartment door and said fresh food compartment door sealably join with said partition when said freezer compartment door and said fresh food compartment door are closed.

11. A cold air circulating apparatus as claimed in claim 10, wherein said evaporator is disposed within said partition.

12. A cold air circulating apparatus as claimed in claim 10, further comprised of said switching means being disposed at an outlet of said guide opening, wherein said outlet communicates with said fresh food compartment.

13. A cold air circulating apparatus as claimed in claim 10, further comprised of said guide opening being disposed between said freezer compartment and said fresh food compartment, and being separated by a width of said freezer compartment from said fan.

14. A cold air circulating apparatus, as claimed in claim 10, wherein said guide opening is a passage formed through said partition.

* * * * *